United States Patent [19]

Blachford

[11] 4,049,680

[45] Sept. 20, 1977

[54] AMIDE WAXES

[75] Inventor: John Blachford, Westmount, Canada

[73] Assignee: H. L. Blachford Limited, Canada

[21] Appl. No.: 529,102

[22] Filed: Dec. 3, 1974

[30] Foreign Application Priority Data

Dec. 20, 1973 Canada ..... 188624

[51] Int. Cl.[2] ..... C11C 3/00; C07C 103/10; C08L 91/00

[52] U.S. Cl. ..... 260/404.5; 260/561 A; 260/561 R; 260/561 N; 260/562 R; 260/562 P; 260/562 A; 106/38.24; 106/38.25

[58] Field of Search ..... 260/404.5, 561 A, 561 R, 260/561 N, 562 R, 562 P, 562 A; 106/38.24, 38.25

[56] References Cited

U.S. PATENT DOCUMENTS

| | | | |
|---|---|---|---|
| 2,742,501 | 4/1956 | Kleine et al. | 260/562 R |
| 2,890,124 | 6/1959 | Mange | 260/404.5 X |
| 3,284,416 | 11/1966 | Kamal | 260/404.5 X |
| 3,517,039 | 6/1970 | Wagner | 260/404.5 |
| 3,535,353 | 10/1970 | Kamal et al. | 260/404.5 |
| 3,632,844 | 1/1972 | Robins | 106/38.24 |
| 3,704,256 | 11/1972 | Shone et al. | 260/404.5 |
| 3,880,642 | 4/1975 | Baker et al. | 260/562 R X |
| 3,888,894 | 6/1975 | Thompson | 260/561 R X |

FOREIGN PATENT DOCUMENTS 1,250,421 10/1971 United Kingdom

OTHER PUBLICATIONS

National Aniline Division Allied Chemical Corporation, 40 Rector Street, New York 6, N. Y., Technical Bulletin I-17, pp. 7-8.

*Primary Examiner*—Patrick P. Garvin
*Assistant Examiner*—William G. Wright
*Attorney, Agent, or Firm*—Diller, Brown, Ramik & Wight

[57] ABSTRACT

Organic amide waxes having at least two amide groups per molecule are prepared by reacting monocarboxylic acids preferably fatty acids with organic di- or polyisocyanates; the wax products are useful particularly as lubricants.

24 Claims, No Drawings

AMIDE WAXES

BACKGROUND OF THE INVENTION

1. Field of the Invention

This invention relates to the manufacture of amide waxes and, more particularly, it relates to the manufacture of bisamide and polyamide waxes from organic isocyanates and monocarboxylic acids. In a further aspect the invention relates to novel waxes.

2. Description of Prior Art

The bisamide waxes ethylene bisstearamide and methylene bisphenylstearamide are known and have a number of uses, for example they are used either alone or in admixture with other materials as lubricants for various applications including the compaction of metal powders; the drawing of wire; the extrusion of plastic pipe; sand shell moulding; the processing of polystyrene and as mould release and detackifying agents for synthetic rubbers.

In addition such bisamide waxes may be used as additives for a number of materials including paper to improve resistance to water and oil; paraffin waxes and asphalts to increase the melting point thereof; adhesives to reduce viscosity and eliminate cold block and tack. Such bisamide waxes are also used as an anti-static agent for cellophane.

At present these bisamide waxes are manufactured commercially by a process in which a fatty acid is reacted with a diamine at a temperature above the melting point of the resulting amide wax; the reaction proceeds with the evolution of water.

The most widely used bisamide wax is ethylenebisstearamide which is made by reacting one mole of ethylenediamine with two moles of stearic acid according to the following equation:

$$NH_2CH_2CH_2NH_2 + 2\,C_{17}H_{35}COOH \rightarrow C_{17}H_{35}-CO-NH-CH_2-CH_2-NH-CO-C_{17}H_{35} + 2\,H_2O \quad (1)$$

In a similar manner there can be prepared methylene bisphenylstearamide by the reaction of stearic acid with methylenedianiline. The reaction is represented by the following general equation in which R represents a phenyl group:

$$NH_2-R-CH_2-R-NH_2 + 2\,C_{17}H_{35}COOH \rightarrow C_{17}H_{35}CONH-R-CH_2-R-NHCOC_{17}H_{35} + 2\,H_2O \quad (2)$$

The manufacture of methylene bisphenylstearamide by the above process is expensive however.

It is an object of the present invention to provide a new and improved method for the manufacture of bisamide waxes and also of polyamide waxes utilizing organic isocyanates selected from diisocyanates, polyisocyanates and mixtues thereof.

It is a further object of the invention to provide new and useful bisamide and polyamide waxes.

SUMMARY OF THE INVENTION

The method of the invention employs a reaction between an organic isocyanate and a monocarboxylic acid.

The advantages of the method of the invention which employs an organic isocyanate instead of a diamine are that the isocyanates are much less toxic than the corresponding diamines and this facilitates their use commercially since their use is safer; further the reaction is faster when using the isocyanates rather than the diamines; and in addition, the carbon dioxide byproduct from the isocyanate reaction is much easier to remove from the reaction mixture than the water which is a byproduct of the known diamine reaction.

According to the invention there is provided a process for preparing organic amide waxes having at least two amide groups per molecule which comprises reacting together in at least approximately stoichiometric amounts, with elimination of carbon dioxide, at least one monocarboxylic acid of the formula $$R_1-COOH$$

wherein $R_1$ is a linear or branched, saturated or unsaturated, substituted or unsubstituted, aliphatic hydrocarbon radical of 5 to 21 carbon atoms and at least one organic isocyanate selected from the group consisting of organic diisocyanates and organic polyisocyanates.

According to another aspect of the invention there is provided new amide waxes of the general formula:

$$R_1-CO-NH-R_2-Z$$

wherein $R_1$ is as defined above; $R_2$ is selected from the group consisting of aliphatic hydrocarbon radicals of at least 6 carbon atoms, phenyl and naphthyl, wherein the phenyl, naphthyl or aliphatic hydrocarbon radicals may be unsubstituted or substituted with one or more of lower alkyl of 1 to 8, preferably 1 to 6, carbon atoms, lower alkoxy of 1 to 8, preferably 1 to 6, carbon atoms, aryl, for example, phenyl, and halogen, for example, chlorine and bromine; and Z is selected from $-NH-CO-R_1$ and $-Alk-(R_1-CO-NH-R_3-CH_2-)_{n-R_4}-NH-CO-R_1$, wherein $R_1$ is as defined above each $R_1$ being the same or different, Alk is a single bond or an aliphatic hydrocarbon radical of 1 to 4 carbon atoms; $n$ is 0 or more; and $R_3$ and $R_4$ which may be the same or different are selected from the same group as $R_2$ and may be the same or different as $R_2$, provided that when $R_1$ corresponds to the aliphatic hydrocarbon radical obtained from commercial grade stearic acid which is a mixture of acids of the general formula $R_1-COOH$, $R_2$ and $R_4$ are unsubstituted phenyl and Alk is methylene, $n$ must be greater than 0.

Generally, in the preferred embodiments the process of this invention, the mono-carboxylic acids of formula $R_1-COOH$ as defined above are selected from the fatty acids which are derived from or contained in animal or vegetable fat or oil, since these are more readily available commercialy. Such acids include those in which the aliphatic hydrocarbon radical is saturated or unsaturated.

In addition the aliphatic radical $R_1$ may be modified by substitution by, for example, hydroxyl, lower alkyl, (1 to 8 carbon atoms) phenyl, chlorine and bromine, and such phenyl substituents may themselves be substituted. Further, in the case of unsaturated monocarboxylic acids, these might be modified by sulphation or sulphonation.

In this specification reference to "monocarboxylic acids" of formula $R_1-COOH$ includes such acids wherein the aliphatic hydrocarbon radical is modified as indicated above, it being understood that such modifications should not be such as to be detrimental to the basic reaction between the carboxylic acid group and the isocyanate group.

In this specification reference to "fatty acids" excludes those monocarboxylic acids of formula $R_1$—COOH wherein $R_1$ is an aliphatic hydrocarbon radical of 5 to 21 carbon atoms which is substituted or otherwise modified. Thus, phenyl substituted stearic acid falls within the broad class of monocarboxylic acids of formula $R_1$—COOH in this invention but falls outside the preferred subclass of fatty acids.

Fatty acids having less than 6 carbon atoms will react to product amides, however, the amide products are not waxes. Fatty acids having greater than 22 carbon atoms are rare and not commercialy available.

The organic isocyanates which are used may be either aliphatic or aromatic; the aliphatic isocyanates are particularly suitable when a wax of light colour is desired; the aromatic isocyanates generally produce waxes of darker colour than those of the aliphatic isocyanate. Light colour may be particularly important when the wax is employed as a lubricant for molding a clear material, for example, clear polystyrene.

In a tangible embodiment of the process of the invention the at least one organic isocyanate has the general formula:

$$NCO—R_2—A$$

wherein $R_2$ is selected from the group consisting of aliphatic hydrocarbon radicals of at least 6 carbon atoms, phenyl and naphthyl; wherein the phenyl, naphthyl and aliphatic hydrocarbon radicals may be unsubstituted or substituted with one or more of lower alkyl of 1 to 8, preferably 1 to 6, carbon atoms, lower alkoxy or 1 to 8, preferably 1 to 6, carbon atoms, aryl for example, phenyl, and halogen, for example, chlorine or bromine; and A is selected from —NCO and —Alk—(-NCO—$R_3$—$CH_2$—)$_n$—$R_4$—NCO wherein Alk is a single bond or an aliphatic hydrocarbon radical of 1 to 4 carbon atoms, $n$ is 0 or more and $R_3$ and $R_4$ which may be the same or different, are selected from the same group as $R_2$ and may be the same or different as $R_2$.

In the above embodiment when $R_2$ is an aliphatic hydrocarbon radical of at least 6 carbon atoms, it includes straight and branched chain radicals and cyclic radicals which may be saturated or unsaturated, for example, cyclohexyl and cyclohexylene.

It is preferable to use isocyanates which are symmetrical or relatively symmetrical since these produce waxes of higher melting point; symmetrical isocyanates produce waxes of a symmetrical structure; the symmetrical nature of the molecules permits better alignment of the molecules in the wax into a stable structure close to a crystalline structure. This results in a high melting point since a greater amount of heat energy is required to break down the stable structure.

Waxes of high melting point are particularly desirable when the wax is to be ground to a powder or flaked form for use as a lubricant since the high melting point makes it easier to subject the wax to a grinding or flaking operation.

By way of example the following mono-basic carboxylic acids, and combinations thereof, can be employed in the process of the invention:

| Saturated | Unsaturated |
|---|---|
| caprylic | oleic |
| capric | linoleic |
| lauric | linolenic |
| myristic | eicosenoic |

-continued

| Saturated | Unsaturated |
|---|---|
| palmitic | lauroleic |
| margaric | myristoelic |
| stearic | palmitoleic |
| arachidic | gadoleic |
| behenic | erucic |
| pelargonic | elaeostearic |
| isostearic | licanic |
| neodecanoic | arachidonic |
| 2-ethyl hexoic | |
| lignoceric | |
| caproic | |
| pentadecanoic | |
| Substituted | |
| hydroxystearic acid | |
| phenylstearic acid | |

Examples of aliphatic diisocyanates that can be used in the process of the invention are as follows:

1,6-hexamethylene diisocyanate
methylcyclohexylene diisocyanate
dicyclohexylmethane diisocyanate
hexamethylene diisocyanate biuret
bis (2-isocyanate ethyl) fumarate
2,6-diisocyanate methyl caproate
3-isocyanate methyl-3,5-trimethyl cyclohexyl isocyanate
2,2,4(2,4,4)-trimethylhexamethylene diisocyanate
trimetylhexamethylene diisocyanate
Dimer acid diisocyanate (DDI)

Dimer acid is a $C_{36}$ dibasic acid obtained by catalytic dimerization of $C_{18}$ unsaturated fatty acids and the diisocyanate may be prepared from it. By way of example diisocyanates may be derived from dimerized linoleic acid.

Some of these are made by hydrogenating the corresponding aromatic diisocyanate.

Examples are aromatic diisocyanates that can be employed in the process of the invention are as follows:

toluene diisocyanate
p,p' and o,p' diphenylmethane diisocyanates (also called methylene bisphenylisocyanate),
dianisidine diisocyanate,
bitolylene diisocyanate
1-chloro-2,4-phenylene diisocyanate,
o,m and p-phenylene diisocyanate,
dichloroxenylene diisocyanate,
2,4-toluene diisocyanate,
2,6-toluene diisocyanate,
2,2', 5,5'-tetramethyl-4,4'-biphenylene diisocyanate,
4,4'-methylenebis (2-methylphenyl isocyanate)
1,5-nephthylene diisocyanate
4,4-diphenylisopropylidine diisocyanate
tolidine diisocyanate
xylylene diisocyanate and
diphenylxenylene diisocyante.

Examples of organic polyisocyanates, which more particularly are oligomeric isocyanates that can be used in the process of the invention are as follows:

polymethylene polyphenylisocyanate
polymethylene polycyclohexylisocyanate

Polymethylene polyphenylisocyanate referred to above can be represented by the following structure:

$$NCO—R—CH_2—(NCO—R—CH_2—)_n—R—NCO$$

wherein R is phenyl and $n$ is 1 or greater and is not necessarily an integer; generally $n$ varies over a wide range within a given sample ($n$ is only an integer for an individual molecule). If $n$ is 0 the material would be methylene bisphenylisocyanate and therefore when $n$ is greater than 0 the material can be considered a polymer of methylene bisphenylisocyanate. If R is cyclohexyl the material would be polymethylene polycyclohexylisocyanate.

As illustrative of the novel process of the invention methylene bisphenylstearamide is prepared by heating methylene bisphenylisocyanate with stearic acid according to the following equation wherein R represents a phenyl group:

$$OCN—R—CH_2—R—NCO + 2\ C_{17}H_{35}COOH \rightarrow C_{17}H_{35}CONH—R—CH_2—R—NHCOC_{17}H_{35} + 2\ CO_2 \quad (3)$$

The temperature at which the reaction is carried out can readily be determined for any particular reactants by experimentation.

It is believed that the reaction proceeds via an intermediate product which is an acid anhydride stable below a certain temperature. The intermediate decomposes on heating and the reaction proceeds to the desired amide wax and carbon dioxide; thus the decomposition temperature of the intermediate acid anhydride represents an effective lower limit for the temperature of the reaction. Another manner of defining the reaction temperature is that it must be sufficiently high to split off carbon dioxide.

If the reaction temperature is too low the reaction proceeds only slowly and lumps form in the reaction mixture which are believed to be composed of the intermediate acid anhydide.

Experiments indicate that the reaction temperature is dependent upon the isocyanate and probably to a lesser degree on the acid.

It is found that for PAPI (trademark of the Upjohn Company for a mixture of about 50% polymethylene polyphenylisocyanate and about 50% methylene bisphenylisocyanate, this mixture is defined by the manufacturer as having a functionality of 3; thus with reference to the formula above for the polymethylene polyphenyl-isocyanate, the value of $n$ is 2 (giving a functionality of 4, i.e. 4 isocyanate groups per molecule); the functionality of the methylene bisphenylisocyanate is 2 giving an average for the mixture of 3) with stearic acid the lower limit for the reaction temperature is about 225° C; and for methylene bisphenyl isocyanate with stearic acid it is about 240° C. For toluene diisocyanate with stearic acid it is lower being of the order of 160° C.

Working reaction temperatures for other reactants within the scope of the invention can be readily determined by experiment.

The upper limit of the reaction temperature is governed by the boiling point of the fatty acid employed and the undesirable dark colour of the product produced at higher temperatures. Furthermore, at high temperatures carbon dioxide will be evolved so rapidly that pronounced foaming will occur. In addition, the reaction temperature should not be so high as to decompose the wax product.

Generally, if an appropriate temperature is selected having regard to the upper and lower limits the reaction is substantially complete within about 30 minutes.

Generally the preferred method of carrying out the reaction is to heat the monocarboxylic acid to a temperature in excess of the decomposition temperature of the intermediate acid anhydride and then slowly add the isocyanate. The reaction is usually complete in 30 minutes to 4 hours. In the alternative, the isocyanate may be heated and the fatty acid added to it. However, this procedure is much less desirable since many of the isocyanates when heated alone at an elevated temperature tend to polymerize, frequently to a considerable extent.

It is desirable in most instances that the acid and the isocyanate be reacted together in at least approximately stoichiometric amounts. If there is an excess of acid the melting point of the amide wax product will be lowered. If there is an excess of the isocyanate, the product will be sensitive to water, because water will react with the free isocyanate with evolution of carbon dioxide and formation of a brittle polymer In view of the reaction of isocyanates with water the process of the invention should be carried out under non-aqueous conditions.

The present invention thus provides an improved process for preparing a wide range of amide waxes of light colour most of which are novel, which in some respects are superior to the commercially available ethylene bisstearamide waxes. For example, the wax produced in Example I below when used as a lubricant for the compaction of metal powders is better than the commercially available ethylene-bisstearamide with regard to compressibility because a denser part can be formed for a given compacting pressure, although it does tend to reduce the flow rate more than with the ethylenebisstearamide.

The amide waxes produced by the process of the invention are used generally in the form of a fine powder having a particle size of about 5 to about 60 microns. However, they might also be used in a flake form.

For some applications, particularly as a lubricant in the manufacture of plastic pipe, the amide wax may be fused with other lubricants, for example, paraffin wax, calcium stearate and stearic acid; the fused mass may then be flaked or if desired ground to a fine powder It should be pointed out that in carrying out the process of the invention on a commercial scale, commercially available materials are utilized. It will be appreciated that commercially available materials are of varying grades of purity.

In the specification, identification of materials by their chemical name is intended to embrace both the chemically pure material and the commercially available product.

For example, the "stearic acid" utilized in the examples illustrating this invention is a "commercial grade stearic acid"; this term covers such products as single pressed, double pressed and triple pressed stearic acid and also mixtures of fatty acids derived from the complete or incomplete hydrogenation and subsequent hydrolysis of certain animal and vegetable fats and oils, for example, tallow fat and soybean oil.

Reference is made to The Condensed Chemical Dictionary, Eighth Edition, 1971, published by Van Norstrand Reinhold Company, at page 825 where commercial stearic acid is defined as being about 50% stearic acid, 45% palmitic acid and 5% oleic acid.

It will be noted that the other fatty acids present in the commercially available product are acids which can themselves be used in the process of this invention.

It will be appreciated that the nature of the commercially available reactants results in wax products which essentially are mixtures of different waxes rather than a single wax.

The invention is illustrated with reference to the following examples which represent preferred procedures and embodiments and are intended merely for purposes of illustration and are not be be construed as limiting the scope of the invention.

EXAMPLE I

Mixture of polymethylene polyphenylisocyanate and methylene bisphenylisocyanate (predominantly the p,p-isomer with a little of the o,p-isomer) reacted with double-pressed stearic acid.

275 grams of double pressed stearic acid (available from Canada Packers Limited; this material is composed of 45% stearic acid, 47% palmitic acid, 5.5% oleic acid, 2% myristic acid and 0.5% margaric acid) were melted and heated to about 225° C. and 135 grams of a commercial grade mixture of 50% polymethylene polyphenylisocyanate and 50% methylene bisphenyliosocyanate (PAPI — trademark — from the Upjohn Company and Mondur MRS — trademark — from Mobay Chemical Company are preferred) were slowly added with stirring. After reacting for 2 hours a brown product was formed which had a melting point of approximately 145° C. and a free fatty acid content of 2%.

EXAMPLE II

Toluene diisocyanate and hydrogenated tallow fatty acid 275 grams of hydrogenated tallow fatty acid (available under the trademark Hyfac 420 from Emery Industries Inc.; this material is composed of 65% stearic acid, 27.5 palmitic acid, 3% myristic acid, 2% oleic acid, 2% margaric acid and 0.5% pentadecanoic acid) were heated to about 160° C. and 87 grams of toluene diisocyanate consisting of 80% of the 2,4-isomer and 20% of the 2,4-isomer were slowly added with stirring. After reacting for 2 hours a light brown product was formed which had a melting point of 124° C. and a free fatty acid content of 1.5%.

EXAMPLE III pp'-diphenylmethane diisocyanate (i.e. methylene bisphenylisocyanate) and lauric acid 200 grams of lauric acid (available under the trademark Hystrene 9512 from Humko Products; this material is composed of 95% lauric acid, 3% myristic acid and 2% capric acid) were heated to about 240° C. and 125 grams of powdered pp'-diphenyl-methane diisocyanate were slowly added with stirring. After reacting for 2 hours a light brown product was formed which had a melting point of 155° C. and a free fatty acid content of 2%.

EXAMPLE IV

Mixture of polymethylene polyphenylisocyanate and methylene bisphenylisocyanate reacted with oleic acid 280 grams of triple pressed oleic acid (available under the trademark Emersol 210 from Emery Industries Inc.,; this material is composed of 71% oleic acid, 8% linoleic acid, 6% palmitroleic acid, 5% palmitic acid, 4% myristoleic acid, 3% myristic acid and 1% of each of margaric acid, stearic acid and linolenic acid) were heated to about 225° C. and 135 grams of a mixture of 50% polymethylene polyphenylisocyanate and 50% methylene bisphenylisocyanate were slowly added with stirring. After reacting for 3 hours a tan product was formed which had a melting point of 120° C. and a free fatty acid content of 2%.

EXAMPLE V pp'-diphenylmethane diisocyanate (methylene bisphenylisocyanate and double pressed stearic acid 275 grams of the double prssed stearic acid used in Example I were heated to 240° C. and 125 grams of pp'-diphenylmethane diisocyanate containing a little o,p-isomer were slowly added with stirring. After reacting for 2 hours a light brown product was formed which had a melting point of 142° C. and a free fatty acid content of 1%.

EXAMPLE VI

Hexamethylene diisocyanate and double pressed stearic acid 275 grams of the double pressed stearic acid of Example I were melted and heated to about 225° C. and 84.1 grams of reagent grade hexamethylene diisocyanate were slowly added with stirring. After reacting of 2 hours a while product was formed which had a melting point of approximately 120° C. and a free fatty acid content of less than 2%.

If desired the wax by the method of the invention may be purified by dissolving in an organic solvent followed by recrystallization of wax. In this way coloured impurities particularly oxidized materials may be removed and a wax of lighter colour obtained.

I claim:

1. A process for preparing organic amide waxes having at least two amide groups of formula —CO—NH— per molecule derived from reaction between carboxylic acid groups and isocyanate groups, which comprises heating to an elevated temperature at least one monocarboxylic acid of the formula $R_1$—COOH wherein $R_1$ is a linear or branched, saturated or unsaturated aliphatic hydrocarbon radical of 5 to 21 carbon atoms, introducng to the acid at least one organic isocyanate having the general formula $$NCO\text{-}R_2\text{—}A$$

wherein $R_2$ is selected from the group consisting of straight chained, branch chained and cyclic aliphatic hydro-carbon radicals of at least 6 carbon atoms, and aromatic hydrocarbon radicals; wherein the aliphatic or aromatic hydrocarbon radical may be unsubstituted or substituted with one or more of lower alkyl of 1 to 8 carbon atoms, lower alkoxy of 1 to 8 carbon atoms, aryl and halogen; and A is selected from —NCO and —Alk—$(NCO—R_3—CH_2—)_n$ —$R_4$—NCO wherein Alk is a single bond or an aliphatic hydrocarbon radical of 1 to 4 carbon atoms, $n$ is 0 or more and $R_3$ and $R_4$ which may be the same or different are selected from the same group as $R_2$ and may be the same or different as $R_2$, and reacting the acid and isocyanate together with elimination of carbon dioxide, said acid and isocyanate being reacted in amounts such that the number of carboxlic acid groups is at least approximately equal to the number of isocyanate groups, and the carboxylic acid groups are in an excess up to completion of amide group formation.

2. A process for preparing organic amide waxes free of isocyanate groups and having at least two amide groups of formula —CO—NH— per molecule derived from reaction between carboxlic acid groups and isocyanate groups which comprises: heating ast least one fatty acid having from 6 to 22 carbon atoms to an elevated temperature, not higher than the boiling point, to form a molten fatty acid phase, slowly adding to the acid, with stirring, at least one organic isocyanate, and reacting the acid with the isocyanate, with elimination of carbon dioxide, in the resulting reaction mixture containing an excess of said acid, to form the amide wax, said isocyanate having the general formula $$NCO—R_2—A$$

wherein $R_2$ is selected from the group consisting of straight chained, branched and cyclic aliphatic hydrocarbon radicals of at least 6 carbon atoms, phenyl and naphthyl; wherein the phenyl, nahthyl or aliphatic hydrocarbon radical may be unsubstituted or substituted with one or more of lower alkyl of 1 to 8 carbon atoms, lower alkoxy of 1 to 8 carbon atoms, aryl and halogen; and A is selected from —NCO and —Alk—(NCO—$R_3$—$CH_2$—)$_n$—$R_4$—NCO wherein Alk is a single bond or an aliphatic hydrocarbon radical of 1 to 4 carbon atoms, $n$ is 0 or more and $R_3$ and $R_4$ which may be the same or different are selected from the same group as $R_2$ and may be the same or different as $R_2$; and continuing the slow addition of the isocyanate to the reaction mixture until the number of isocyanate groups added is at least approximately equal to the original number of carboxylic acid groups such that said acid groups are in an excess up to completion of said amide group formation.

3. A process according to claim 2, wherein said elevated temperature is from about 160° C to about 240° C and the reaction is complete in 30 minutes to 4 hours; the fatty acid and isocyanate being reacted in amounts such that the amide wax contains not more than about 2% by weight of free acid.

4. A process according to claim 3, including the step of grinding the amide wax obtained to a powder having a particle size of about 5 to about 60 microns.

5. A process according to claim 3, wherein said reaction mixture is non-aqueous and free of solvent for said acid and isocyanate.

6. A process according to claim 5, wherein said at least one fatty acid contains 10 to 18 carbon atoms.

7. A process as defined in claim 1, wherein said at least one acid is selected from the fatty acids.

8. A process as defined in claim 7, wherein said at least one acid is a commercial grade of stearic acid.

9. A process as defined in claim 7, in which the fatty acid is commercial stearic acid and the isocyanate is a mixture of a polymethylene polyphenylisocyanate and methylene bisphenylisocyanate.

10. A process as defined in claim 9, in which said mixture contains about 50% by weight of each of said isocyanates.

11. A process as defined in claim 10, wherein said polyphenylisocyanate has the formula:

$$NCO—R—CH_2—(NCO—R—CH_2—)_n—R—NCO$$

wherein R is phenyl and $n$ is 2.

12. A process as defined in claim 11, carried out at a temperature of about 225° C.

13. A process as defind in claim 1, comprising reacting a commercial grade of stearic acid with methylene bisphenylisocyanate.

14. A process, as defined in claim 13, carried out at a temperature of about 240° C.

15. A process as defined in claim 1, comprising reacting a commercial grade of stearic acid and a polymethylene polyphenylisocyanate represented by the structure $$NCO—R—CH_2—(NCO—R—CH_2)_n—R—NCO$$

where $n$ is a number of one or more and R is a phenyl group.

16. A process as defined in claim 1, comprising reacting commercial grade stearic acid with a mixture of 2,4- and 2,6-toluene diisocyanate.

17. A process as defined in claim 1 comprising reacting commercial grade stearic acid with hexamethylene diisocyanate.

18. A process as defined in claim 1, wherein said at least one monocarboxylic acid is selected from the group consisting of the following acids:

| Saturated | Unsaturated |
|---|---|
| caprylic | oleic |
| capric | linoleic |
| lauric | linolenic |
| myristic | eicosenoic |
| palmitic | lauroleic |
| margaric | myristoleic |
| stearic | palmitoleic |
| arachidic | gadoleic |
| behenic | erucic |
| pelargonic | elaeostearic |
| isostearic | licanic |
| neodecanoic | arachidonic |
| 2-ethyl hexoic | |
| lignoceric | |
| caproic | |
| pentadecanoic | |

19. A process as defined in claim 1, wherein said at least one isocyanate is an aromatic diisocyanate selected from the group consisting of:

toluene diisocyanate,
bitolylene diisocyanate,
dianisidine diisocyanate,
p,p'-diphenylmethane diisocyanate
o,p'-diphenylmethane diisocyanate
1-chloro-2,4-phenylene diisocyanate
o,m and p-phenylene diisocyanate
dichloroxenylene diisocyanate
2,4-toluene diisocyanate
2,6-toluene diisocyanate
2,2', 5,5'-tetramethyl-4,4'-biphenylene diisocyanate
4,4'-methylenebis (2-methylphenyl isocyanate)
1,5-naphthylene diisocyante
4,4-diphenylisopropylidine diisocyanate
tolidine diisocyanate,
xylylene diisocyanate, and
diphenylxenylene diisocyanate.

20. A process as defined in claim 1, wherein said isocyanate is selected from polymethylene polyphenylisocyanate and polymethylene polycyclohexylisocyanate.

21. A process as defined in claim 1, wherein said isocyanate is an aliphatic diisocyanate selected from 1,6-hexamethylene diisocyanate methylcycohexylene diisocyanate dicyclohexylmethane diisocyanate trimethylhexamethylene diisocyanate 3-isocyanate methyl-3,5-trimetyl cyclohexyl isocyanate 2,2,4(2,4,4)-trimethylhexamethylene diisocyanate.

22. A process as defined in claim 1, wherein said isocyanate is a dimer acid diisocyanate derived from dimerized linoleic acid.

23. A process as defined in claim 1, wherein said isocyanate is selected from isocyanates having a symmetrical structure.

24. A process as defined in claim 1, carried out at an elevated temperature effective to decompose an intermediate acid anhydride formed in the course of the reaction thereby avoiding formation of lumps.

* * * * *